United States Patent [19]

Bellaire

[11] Patent Number: 5,030,242

[45] Date of Patent: Jul. 9, 1991

[54] METHOD OF IMPARTING RANDOM COLORATION PATTERNS IN FABRIC

[76] Inventor: David L. Bellaire, 2215 W. Mountain View, Phoenix, Ariz. 85021

[21] Appl. No.: 383,930

[22] Filed: Jul. 21, 1989

[51] Int. Cl.[5] ..... D06P 5/00; D06P 5/15; D06P 5/20; D06Q 1/12

[52] U.S. Cl. ..... 8/483; 8/478; 8/638; 8/636; 8/114; 8/158

[58] Field of Search ..... 8/453, 101, 107–111, 8/, 158, 478, 636, 638

[56] References Cited

U.S. PATENT DOCUMENTS 4,740,213 4/1988 Ricci ..... 8/108.1
4,816,033 3/1989 Hoffer et al. ..... 8/158
4,850,156 7/1989 Bellaire ..... 51/293

FOREIGN PATENT DOCUMENTS 2098412 1/1989 European Pat. Off. .
2515105 10/1975 Fed. Rep. of Germany .

*Primary Examiner*—Paul Lieberman
*Assistant Examiner*—J. E. Darland
*Attorney, Agent, or Firm*—Cahill, Sutton & Thomas

[57] ABSTRACT

The method of providing random coloration patterns in fabric using dye impregnated pumice and tumbling with the fabric followed by the use of dye-fixing impregnated pumice and repeating the tumbling sequence. A number of different colored dye solutions can be used in a series of steps to provide a variety of shadings and random color patterns for the treated fabric.

20 Claims, 1 Drawing Sheet

METHOD OF IMPARTING RANDOM COLORATION PATTERNS IN FABRIC

BACKGROUND OF THE INVENTION

This invention relates to a series of steps for imparting unpredictable color patterns in fabric and, in particular, the generation and dye-fixing of color patterns concurrently with the intentional distressing of denim garments.

Current trends in the fashion industry have generated increasing interest in the use of the relatively coarse denim fabric for a wide variety of different garments. Initially, blue denim fabric achieved popularity because of its wear resistance and relatively low cost. However, in recent years fashion trends have found the denim fabric to be worn in virtually every social setting without regard to its traditional ability to withstand wear. One of the first trends has been the intentional fading of garments fabricated from blue denim effected by repeated washings and often accompanied by immersion in a bleaching solution by the user. This was followed by a pretreatment, prior to sale, of the fabricated denim garments in order to provide a softening in addition to the prefading indicative of long term use. Next came a pretreatment or preconditioning process that intentionally distressed the denim garments so that they were more than just faded but had actually been abraded so as to appear scuffed and subjected to lengthy periods of hard use.

The intentional distressing gave rise to the use of abrasive elements which are placed in intimate contact with the garment to create the scuffed or distressed appearance. It has now become industry practice to soak porous abrasive elements in bleaching solutions in order to conduct both the initial fading and the intentional abrasion in the same process. This preconditioning sequence is generally referred to as stone-washing with the garment and the porous abrasive rocks in a tumbling apparatus. Typically, conventional chlorine bleaches, such as sodium hypochlorite, whose properties have been well known in the industry for a long period of time have been utilized for the faded appearance.

Since the fashion industry is continually seeking new looks, the successor to the stone-washing process and its abrasive conditioning of the garment have been the topic of great commercial interest. It is recognized that the fashion look produced by the conventional bleaching agents has been found to be limited in range of coloration. As a result, the industry moved toward the use of stronger bleaching agent solutions such as the permanganates. This change increased the coloration range of the bleaching process extending it from a mottled white denim to the well-known traditional blue. In certain cases, the bleaching agent has been made strong enough so that in combination with the action of the abrasive rocks a near white or fully bleached distressed garment is manufactured.

In an attempt to create different coloration effects, sponge dyeing followed by immersion in a dye-fixing wash solution has been employed to provide shadings or indistinct color variation in a garment. This technique has been used after the distressing of the fabric. It is normally characterized by a lack of a distinctive coloration pattern since the variations in coloration across the fabric are due to dye migration. Lacking in the fabric treating industry is the ability to provide distressed effects and at the same time introduce coloration patterns marked by clear and distinctive outlines. Further, the production of defined patterns of multiple colors has not been heretofore commercially available to the industry.

Accordingly, it is a primary objective of the present invention to provide a method for imparting a well-defined random coloration pattern to treated fabric. Also, the invention is directed to the fixing of the random coloration pattern in the fabric to produce a lasting distinctive pattern therein. Furthermore, the invention is concerned with introducing a plurality of colors to the fabric through the use of the present method in order to achieve true random patterns of multiple colors. These benefits accrue through use of the process while still effecting the abrasion characteristic of the currently fashionable, intentionally distressed garment.

SUMMARY OF THE INVENTION

This invention relates to a novel method of imparting random coloration patterns in fabric, typically denim garments, which comprises a sequence of steps utilizing impregnated porous abrasive elements. The present method begins with the placing of the fabric to be treated in a container along with a multiplicity of porous elements containing a first dye solution in their pore spaces. The fabric and elements are agitated to provide repeated contact between fabric and impregnated elements to thereby deposit the first solution on the fabric at areas of contact. This can be performed in the conventional tumbling apparatus now used with the bleach-containing abrasive pumice elements available in the marketplace.

Following the tumbling of the fabric with the elements containing the first solution, the fabric is removed from the container of the tumbling apparatus and, if desired, the fabric can be subjected to a wash or rinse to remove granules of pumice. The next sequence of steps in the method includes placing the fabric in the same or similar container with a multiplicity of porous elements containing a second or dye-fixing solution in its pore spaces and causing repeated contact therebetween. As a result of the contact, the second elements deposit the dye-fixing solution, typically a high pH solution, on the fabric at the areas of contact therebetween. The dye-fixing solution so deposited results in the dye imparted by prior contact with the porous elements of the process to become permanently fixed. Following the treatment with the second elements, the fabric is removed from the tumbling apparatus and preferably laundered to remove any undesired unfixed dye and the residue of the dye-fixing solution.

The porous abrasive elements containing the dye and dye-fixing solutions are typically formed of pumice or other volcanic rock. Their preparation is accomplished by either the method set forth in my co-pending U.S. patent application Ser. No. 118,167 METHOD OF IMPREGNATING POROUS ABRASIVE ELEMENTS FOR USE IN DISTRESSING FABRICS, filed Nov. 9, 1987, or by immersion in the appropriate solution for a lengthy period of time. In the method disclosed in my pending application, the porous elements are impregnated with solution through a vacuum process which causes the elements to become impregnated throughout their cross-section. As a result, the coloration effects continue to take place as the erosion of these elements occurs during tumbling.

The present process can utilize a plurality of steps with different porous elements each containing a different dye solution in a sequence determined by the overall coloration result desired by the operator. In addition, the dye-fixing solution can also impact the resultant visual effect. Consequently, this type of impregnated element can be utilized at different intervals in the process with a variety of different results. Thus, the present method produces a true random coloration process for fabric which utilizes existing commercial laundry equipment. Further features and advantages of the present method will become more readily apparent from the following detailed description of a preferred embodiment thereof.

DESCRIPTION OF THE PREFERRED EMBODIMENT

Figure 1:
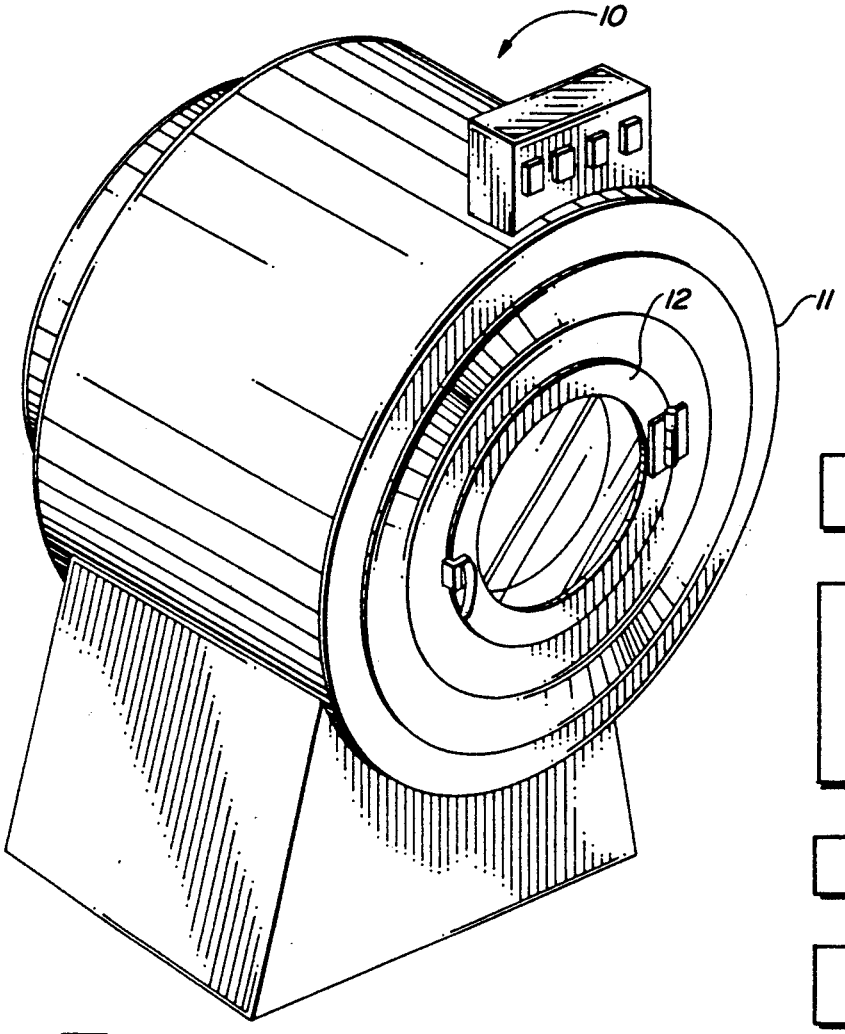
FIG. 1 is a perspective view showing a typical tumbling apparatus for use in connection with the present invention.

In the present invention, a series of process steps are utilized to produce a random coloration of fabric in a manner which provides striking visual effects. The process requires repeated contact between the fabric being treated and porous elements whose primary function is to serve as host for different solutions contained therein. An important feature of this invention is the ability to conduct the process steps using conventional laundry equipment and, to that end, FIG. 1 shows an end-loading washer which is typical of the type of machine now utilized throughout the country to treat and launder durable fabric such as denim.

The end-loading washer 10 is characterized by a water-tight housing 11 having input and output fluid ports (not shown) with a tumbling assembly mounted therein for rotation about a horizontal axis. The tumbling assembly is driven from an external electric motor, not shown, by means of a shaft and pulley combination.

The front-loading door 12 allows the fabric being treated and the elements serving as host for the solution contained therein to be conveniently loaded by the operator. When the materials are in place, the door is closed and the tumbling apparatus is actuated bringing the fabric and host elements into repeated contact. The horizontal orientation of the tumbling action is preferred since gravity aids in causing repeated mutual contact but it is recognized that the tumbling action can be provided by other axial orientations as well.

In the manufacture of denim garments, it is common to have the fabric as produced contain sizing and waxes. The presence of these substances detracts from the efficacy of the present method if they are permitted to remain so that an initial washing is recommended. The garment can be washed in a conventional detergent solution with centrifugal force being used to drive much of the remaining moisture from the fabric. The residual moisture content of the fabric after spin-drying can be utilized in the practice of the present coloration method since it does affect the overall appearance of the garment after coloration. However, the fabric can be dried further based on the resultant look that is sought. In practice, about one-half the moisture is removed from the fabric prior to initiating the steps of the present method.

Next, the fabric is placed in the tumbling apparatus through the front-loading opening shown in the FIG. 1 along with a multiplicity of first porous abrasive elements which have been impregnated with the first solution. The first elements are comprised of pumice or other volcanic rock which exhibits a roughened exterior and also possesses a significant porosity. These first elements have their pore spaces filled with either a dyeing solution or a dye-fixing solution. A second set of like porous elements impregnated with the other of the solutions is used in a later step.

The fabric and the first elements are tumbled in the apparatus which causes repeated contact between fabric and abrasive element. As a result, the fabric is physically worn or distressed and the solution contained in the pore spaces is deposited on the surface of the fabric thereby producing the desired effect. In the case of a dyeing solution being contained in the first elements, the dye is deposited upon contact with the fabric in a random manner as a result of the tumbling causing an unpredictable pattern of contact. The tumbling process results in repeated interaction between the dye-containing elements to produce clearly defined outlines of differing shades of coloration since some surface areas of the fabric will be contacted more than once.

Also, the abrasive nature of the porous rock imparts a distressed appearance to the garment. The limited abrasion of the fabric aids in producing the unique coloration of the fabric treated in accordance with the present method. As the abrasive elements contact the fabric, the solution contained in the pore spaces is deposited on the garment at the points of contact. The element is eroded as a result of the tumbling and continued contact exposes additional amounts of the solution to the fabric. In practice, the tumbling can be continued until the elements erode into small particles.

The dye solution can include commercially available contact or fiber-reactive dyes in water. The use of fiber-reactive dyes is preferred since they are recognized to provide a longer-lasting coloration. Both dyes are dissolved in water according to the instructions of the dye manufacturer. The solution preferably includes a surfactant to prevent evaporation during storage along with a wetting agent to aid fluid flow into the pore spaces of the pumice elements during impregnation. After the tumbling with the first set of dye stones has taken place, the fabric is removed from the tumbling apparatus. If an additional color is to be imparted to the fabric, the fabric is placed in another tumbling apparatus with a different set of dye stones and the tumbling operation is repeated. The result will be two distinctive and well-defined patterns of coloration which overlap in part to provide variations that are unique to each garment so treated.

In each of the dye stone operations, the ratio of the weight of the garments to the initial weight of the dye stone determines the length of time needed for the tumbling operation to produce a desired result. The present guidelines used in the practice of the present method call for 2 lbs. of dye stones for each 1 lb. of dry garment. In the typical case where the garment contains an equal weight of moisture, the ratio is preferably adjusted to 1:1. As mentioned, the amount of moisture remaining in the garment after it has been laundered to remove the waxes, oils and sizing used to weave and manufacture the garment affects the overall look of the treated garment and can be varied as desired. In practice, goods visual results are obtained with the range of moisture content remaining in the garment in the approximate range of 35 to 50 weight percent. However, the dye stones do produce varied coloration results with garments that are dry, damp or wet. In each case, the process creates a different coloration pattern on the garment. Also, it should be noted that the tumbling process can be repeatedly run with different color dye stones to produce widely varied patterns with a different tumbling apparatus used for each dye to avoid color contamination.

At the completion of dye stone tumbling, the garments are removed from the tumbling apparatus and manually shaken to remove the pumice particles from the folds, creases and seams of the garments preparatory prior to placing them in yet another tumbling apparatus to effect the dye-fixing portion of the process.

Next, a quantity of porous abrasive elements impregnated with an alkali solution for dye-fixing is added to the tumbling apparatus. The solution contained therein is deposited on the fabric surface at the points of contact with the elements. The alkali solution causes the dye to fix on the garment immediately. In practice, a fixing solution comprised of 25% caustic soda, 55% water and 20% sodium silicate has been found to provide excellent results. Other aqueous caustic solutions can be used based on the specification of the dye used. The caustic soda and water provide the high pH needed for dye fixing, while the sodium silicate is used primarily to improve storage lifetime of the set stones by substantially reducing the tendency of the alkali solution to evaporate or drain from the pores of the elements.

The tumbling of the garments with the set stones is found to cause a deposit of a residue comprising a combination of the alkali solution and a portion of the stone. This residue remains on the fabric surface to promote the fixing of the dye on the underlying surface. In the present method, the dye becomes fixed in a matter of seconds. The dye-fixing tumbling operation is normally about five minutes in length depending upon the density of the desired color pattern. The ratios of set stones to fabric is approximately the same as used with the dye stones, but can be varied based on the desired density of the pattern.

Upon completion of the dye-fixing tumbling step, the garments are removed from the tumbling apparatus and subjected to a normal laundering using a water temperature suggested by the garment manufacturer for that type of fabric. The presence of particles of the disintegrated elements may require multiple rinse cycles to rid the garments of all particulate matter.

Figure 2:
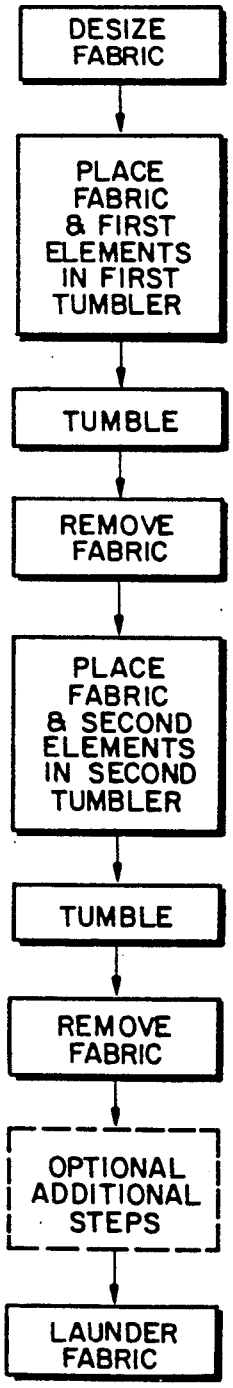
FIG. 2 is a block diagram showing the sequence of fabric treatment in accordance with the present method.

The utilization of dye-stones produces a random well-defined coloration, the definition of which is enhanced by the use of impregnated set stones to develop a strongly defined random pattern of one or more fixed colors that it is distinctively different from the gradual color shadings obtained with prior art processes. While the foregoing description has referred to the use of a single dye stone step in combination with a set stone step, it is to be noted that the order of the steps and the number of dye-imparting steps may be varied as shown in FIG. 2 to produce differing coloration effects without departing from the scope of the invention as claimed.

I claim:

1. A method of imparting random coloration to fabric, said method comprising the steps of:

a) contacting the fabric with porous first elements containing a first solution in the pore spaces of the first elements to deposit the first solution on the fabric at areas of contact; and b) further contacting the fabric with porous second elements containing a second solution in the pore spaces of the second elements to deposit the second solution on the fabric at areas of contact, one of the first and second solutions including a dyeing solution and the other including a dye-fixing solution whereby a random coloration pattern is fixed in the fabric.

2. The method as set forth in claim 1 wherein the first porous elements have an abrasive surface and including the step of distressing the fabric during repeated contact with the abrasive surface.

3. The method as set forth in claim 1 wherein said steps of contacting and further contacting each comprise the step of tumbling the fabric and the first and second porous elements, respectively, in a container.

4. The method as set forth in claim 2 further comprising the step of moistening the fabric to be treated prior to contact with the first porous elements.

5. The method as set forth in claim 2 wherein the second porous elements have an abrasive surface and including the step of further distressing the fabric during repeated contact with the abrasive surfaces.

6. The method as set forth in claim 1 wherein said step of contacting results in repeated contact with the first elements impregnated with a dye solution.

7. The method as set forth in claim 6 wherein said step of contacting results in repeated contact with the second elements impregnated with a dye-fixing solution.

8. The method as set forth in claim 7 wherein the weight of the fabric to the first elements is 1 to 2 by weight.

9. The method as set forth in claim 8 including the step of laundering the fabric following removal of the fabric from the container.

10. The method as set forth in claim 9 including a step of initially laundering the fabric to remove manufacturing residue.

11. The method as set forth in claim 7 further comprising the steps of:

a) yet further contacting the fabric with third porous elements containing a third solution in the pore spaces of the third porous elements following said step of contacting the fabric with the first porous elements; and b) causing repeated contact between the fabric and the third porous elements to deposit the third solution on the fabric at areas of contact.

12. The method as set forth in claim 11 wherein step of causing is carried out with the third porous elements impregnated with a dye solution differing from the dye solution impregnated in the first porous elements.

13. A method for imparting random coloration to fabric, said method comprising the steps of:

A) tumbling the fabric with porous first elements containing a dye solution uniformly impregnated throughout the first elements to deposit the dye solution on the fabric with a uniform concentration at the areas of contact;

B) further tumbling the fabric with porous second elements containing a dye-fixing solution uniformly impregnated throughout the second elements to deposit the dye-fixing solution on the fabric with a uniform concentration at areas of contact; and C) distressing the fabric during at least one of said steps of tumbling and further tumbling.

14. The method as set forth in claim 13 including the step of washing the fabric to remove sizing and waxes prior to exercise of said step of tumbling.

15. The method as set forth in claim 14 including the step of spin drying the fabric after exercise of said step of washing to remove no more thabn 50 to 65 percent by weight of moisture from the garment prior to exercise of said step of tumbling.

16. The method as set forth in claim 13 including the step of establishing a moisture content of the fabric in the range of 35 to 50 percent by weight.

17. The method as set forth in claim 1 including the steps of yet further tumbling the fabric with porous third elements containing a third solution uniformly impregnated throughout the third elements to deposit the third solution on the fabric with a uniform concentration at areas of contact, said yet further tumbling step being carried out prior to exercise of said further tumbling step.

18. The method as set forth in claim 17 wherein the third solution is a dye and wherein said step of tumbling comprises the step of further developing the random coloration pattern with two colors.

19. The method as set forth in claim 18 including the step of further distressing the fabric during said step of yet further tumbling the fabric.

20. The method as set forth in claim 19 including the step of laundering the fabric subsequent to said step of further tumbling.

* * * * *